US011174776B2

(12) United States Patent
Perret et al.

(10) Patent No.: US 11,174,776 B2
(45) Date of Patent: Nov. 16, 2021

(54) OPTIMIZED COMPONENT FOR PURIFYING EXHAUST GASES

(71) Applicant: FAURECIA SYSTEMES D'ECHAPPEMENT, Nanterre (FR)

(72) Inventors: Jean François Perret, Chevremont (FR); Catherine Guyard, Besancon (FR); Benoit Poutot, Blamont (FR); Thomas Brenckle, Phaffans (FR)

(73) Assignee: FAURECIA SYSTEMES D'ECHAPPEMENT

( * ) Notice: Subject to any disclaimer, the term of this patent is extended or adjusted under 35 U.S.C. 154(b) by 0 days.

(21) Appl. No.: 15/733,992

(22) PCT Filed: Jun. 6, 2019

(86) PCT No.: PCT/EP2019/064858
§ 371 (c)(1),
(2) Date: Dec. 1, 2020

(87) PCT Pub. No.: WO2019/234184
PCT Pub. Date: Dec. 12, 2019

(65) Prior Publication Data

US 2021/0215086 A1 Jul. 15, 2021

(30) Foreign Application Priority Data

Jun. 6, 2018 (FR) ..... 18 54902

(51) Int. Cl.
*F01N 3/28* (2006.01)
*F01N 13/14* (2010.01)
*F01N 13/00* (2010.01)

(52) U.S. Cl.
CPC ..... *F01N 13/148* (2013.01); *F01N 3/2853* (2013.01); *F01N 13/0097* (2014.06); *F01N 2260/20* (2013.01); *F01N 2510/02* (2013.01)

(58) Field of Classification Search
CPC .. F01N 13/148; F01N 13/0097; F01N 3/2853; F01N 2510/02; F01N 2260/20
(Continued)

(56) References Cited

U.S. PATENT DOCUMENTS 5,250,269 A 10/1993 Langer
2007/0065349 A1* 3/2007 Merry ..... C03C 3/087 422/179
2015/0152772 A1* 6/2015 Wikaryasz ..... F01N 13/1872 422/171

FOREIGN PATENT DOCUMENTS

WO 9850688 A1 11/1998
WO 2015053251 A1 4/2015
(Continued)

OTHER PUBLICATIONS

International Research Report for PCT/EP2019/064858 dated Jul. 9, 2019.

*Primary Examiner* — Tom P Duong
(74) *Attorney, Agent, or Firm* — Carlson, Gaskey & Olds, P.C.

(57) ABSTRACT

A purification component comprises at least one block for purifying exhaust gases, and a casing that defines a circulation channel for the exhaust gases extending along a longitudinal axis, and in which the purification block is housed. The casing comprises an inlet portion, an outlet portion, and a central portion arranged between the inlet portion and the outlet portion, and with the central portion surrounding the purification block. A thermal insulator covers the whole of the casing. The thermal insulator comprise a first part, having a first temperature resistance, arranged radially facing the purification block, and a second part, having a second temperature resistance greater than the first temperature resistance, covering at least the inlet portion of the casing.

11 Claims, 1 Drawing Sheet

(58) Field of Classification Search
USPC ..... 422/179, 171
See application file for complete search history.

(56) References Cited

FOREIGN PATENT DOCUMENTS

| | | | |
|---|---|---|---|
| WO | 2015175204 | A1 | 11/2015 |
| WO | 2017116777 | A1 | 7/2017 |

* cited by examiner

OPTIMIZED COMPONENT FOR PURIFYING EXHAUST GASES

CROSS-REFERENCE TO RELATED APPLICATIONS

This application is the US national phase of PCT/EP2019/064858, filed Jun. 6, 2019, claiming the benefit of French Application No. 18 54902, filed on Jun. 6, 2018, which is incorporated herein by reference in its entirety.

TECHNICAL FIELD

The present disclosure relates to a vehicle exhaust gas purification device, for example intended to equip a motor vehicle.

BACKGROUND

Already known in the state of the art is an exhaust gas purification component, including:

at least one exhaust gas purification block, a casing defining a circulation channel for the exhaust gases extending along a longitudinal axis, in which the purification block is housed, the casing comprising an inlet portion and an outlet portion, and a central portion arranged between the inlet portion and the outlet portion, the central portion surrounding the purification block, and at least one element for maintaining the purification block, inserted between the casing and the purification block.

Such a purification component typically includes a thermally insulating material. The temperature of the exhaust gases being high, this thermally insulating material must have a good resistance to the temperature so as not to be damaged by this temperature.

In the present disclosure, the temperature resistance of a material refers to its ability to retain its properties, in particular its thermal and mechanical properties, as long as the temperature is below a temperature specific to this material. A resistance to high temperature means that this specific temperature is high.

A thermally insulating material having a resistance to high temperature generally has a high cost.

SUMMARY

The present disclosure in particular aims to provide a more cost-effective purification component, without harming its thermal insulation capacities.

To that end, the disclosure in particular relates to an exhaust gas purification component, including:

at least one exhaust gas purification block, and a casing defining a circulation channel for the exhaust gases extending along a longitudinal axis, in which the purification block is housed, the casing comprising an inlet portion and an outlet portion, and a central portion arranged between the inlet portion and the outlet portion, the central portion surrounding the purification block.

Said exhaust gas purification component further comprises a thermal insulator covering the whole of the casing, the thermal insulator comprising:

a first part, having a first temperature resistance, arranged radially facing the purification block, and a second part, having a second temperature resistance greater than the first temperature resistance, covering at least the inlet portion of the casing.

It appears that the temperature of the exhaust gases is particularly high at the inlet and outlet portions of the casing. The disclosure therefore provides for differentiating the inlet and outlet portions on the one hand, and the central portion on the other hand, to assign them thermally insulating parts having different temperature resistances. The thermally insulating part connected to the central portion has a lower temperature resistance than that in the thermally insulating part connected to the input and output portions, and therefore a lower cost. As a result, the general cost of the thermal insulation is reduced.

A purification component according to the disclosure may further include one or more of the following features, considered alone or according to any technically possible combinations:

the second part of the thermal insulation is discontinuous and covers the outlet portion of the casing;

the first part of the thermal insulation is formed by a first insulating material, and the second part of the thermal insulation is formed by a second insulating material different from the first insulating material.

the thermal insulation includes:

a first layer formed from a first insulating material having the first temperature resistance, and covering the whole of the casing, and a second layer formed from a second insulating material different from the first insulating material, the second part of the thermal insulation being formed by superimposing the first and second layers.

the second insulating material is arranged in contact with the casing, and the first insulating material surrounds the second insulating material;

the thermal insulation includes a single insulating material, having a first thickness in the first part, and a second thickness greater than the first thickness in the second part;

said purification component according to the aforementioned type comprises at least two purification units in series in the exhaust gas circulation channel, separated in the direction of the longitudinal axis by a space, the first part of the thermal insulation being discontinuous and extending radially across from each of these purification blocks;

the second part of the thermal insulation covers the casing radially across from the space between the purification blocks;

said purification component according to the preceding type includes at least one element for maintaining the purification block, inserted between the casing and the purification block, wherein the first part of the thermal insulation is arranged radially facing the maintaining element;

the first part of the thermal insulation has a first temperature resistance, making it possible to withstand at least a first temperature, and the second part of the thermal insulation has a second temperature resistance, making it possible to withstand at least a second temperature, such that:

the second temperature is at least equal to a maximum temperature of the exhaust gases, and the first temperature is at least 100° lower than the second temperature.

BRIEF DESCRIPTION OF THE DRAWINGS

The disclosure will be better understood upon reading the following description, provided solely as an example and done in reference to the appended figures, in which.

DETAILED DESCRIPTION

Figure 1:
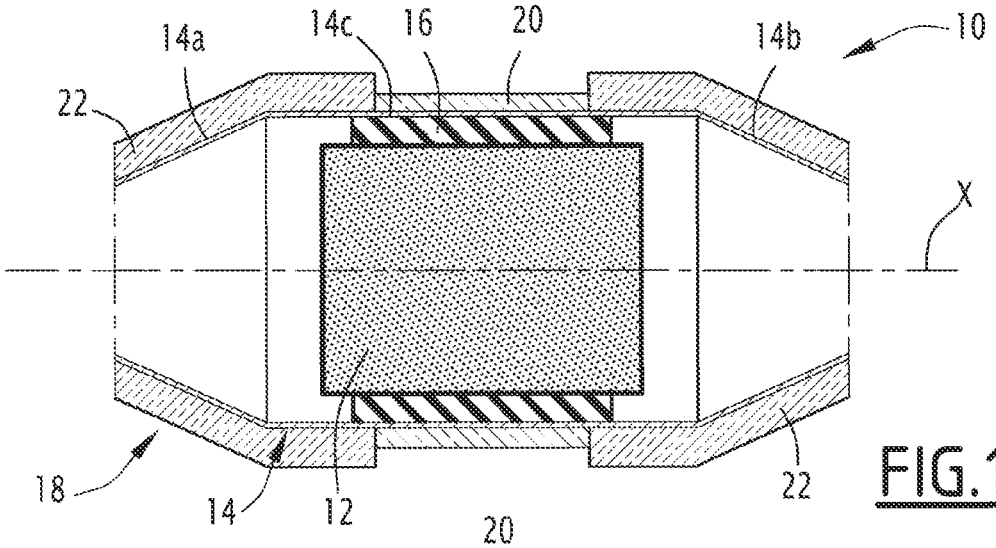
FIG. 1 is a schematic longitudinal sectional view of a purification component according to a first exemplary embodiment of the disclosure.

FIG. 1 shows an exhaust gas purification component 10, for example intended to equip a motor vehicle.

Conventionally, the purification component 10 comprises at least one exhaust gas purification block 12, and a casing 14 delimiting a circulation channel for the exhaust gases extending along the longitudinal axis X, in which the purification block 12 is housed. The casing 14 is, for example, made from metal.

More specifically, the casing 14 comprises an inlet portion 14*a*, an outlet portion 14*b*, and a central portion 14*c* arranged between the inlet portion 14*a* and the outlet portion 14*b*, the central portion 14*c* surrounding the purification block 12.

The purification component 10 also includes at least one element 16 for maintaining the purification block 12, inserted between the central portion 14*c* of the casing 14 and the purification block 12. For example, the purification component 10 includes a single maintaining element 16 wholly, or quasi-wholly, surrounding the purification block 12, or in a variant it includes a plurality of maintaining elements 16 together surrounding the purification block 12, partially or wholly, so as to prevent any relative movement of the purification block 12 with respect to the casing 14, in particular in any direction perpendicular to the longitudinal axis X.

It will be noted that the inlet portion 14*a* extends to the maintaining element 16, and the outlet portion 14*b* extends from the maintaining element 16. Thus, the inlet portion 14*a* corresponds to the portion of the casing 14 intended to be in contact with the exhaust gases entering the purification component 10, and the outlet portion 14*b* corresponds to the portion of the casing 14 intended to be in contact with the exhaust gases leaving the purification component 10.

The purification component 10 includes a thermal insulation 18 covering the whole of the casing 14.

According to the disclosure, the thermal insulation 18 includes:

- a first part 20 having a first temperature resistance, arranged radially facing the purification block 12, and
- a second part 22, having a second temperature resistance higher than the first, covering at least the inlet portion 14*a* of the casing.

It will be recalled here for all useful purposes that the temperature resistance of a material refers to its ability to retain its properties, in particular its thermal and mechanical properties, as long as the temperature is below a temperature specific to this material. A high temperature resistance means that this specific temperature is high.

Thus, the first part 20 of the thermal insulation 18 has a first temperature resistance, making it possible to withstand at least a first temperature, and the second part 22 of the thermal insulation 18 has a second temperature resistance making it possible to withstand at least a second temperature.

For example, the second temperature is at least equal to a maximum temperature of the exhaust gases, and the first temperature is at least 100° C. less than the second temperature.

One skilled in the art will know how to determine whether the thermal resistance of an insulation material is sufficient for the considered temperatures, and will therefore know how to choose the first 20 and second 22 parts of the thermal insulation 18.

As previously indicated, the first part 20 of the thermal insulation 18 is arranged radially facing the purification block 12. In other words, any plane perpendicular to the longitudinal axis X, and passing through the first part 20 of the thermal insulation 18, also passes through the purification block 12.

Advantageously, the first part 20 of the thermal insulation 18 is arranged radially facing the maintaining element 16. In the described example, the length of the first part 20 of the thermal insulation 18 in the direction parallel to the longitudinal axis X is less than or equal to the length of the maintaining element 16 in the same direction. Preferably, the length of the first part 20 of the thermal insulation 18 in the direction parallel to the longitudinal axis X is strictly less than the length of the maintaining element 16 in the same direction, taking account of the respective dimensional allowances of the maintaining element 16 and the thermal insulation 18.

In the described example, the second part 22 of the thermal insulation 18 is discontinuous. Indeed, this second part 22 extends on the one hand over the inlet portion 14*a* and over part of the central portion 14*c* adjacent to the inlet portion 14*a*, and on the other hand over the outlet portion 14*b* and over part of the central portion 14*c* adjacent to the outlet portion 14*b*.

More specifically, any part of the thermal insulation 18 that is not the first part 20 is part of the second part 22.

According to this first embodiment, the thermal insulation 18 is formed by three separate insulating elements, a first of which forms the first part 20, and two second ones together forming a discontinuous second part 22.

The first insulating element is, for example, formed in a first insulating material, and the second insulating elements in a second insulating material different from the first insulating material. In the described example, the first insulating element has a thickness different from that of the second insulating elements, but in a variant it could have a thickness equal to that of the second insulating elements.

It will be noted that the first insulating material can be a fibrous or microporous product, with a base of different materials such as silicon dioxide, high-temperature glass, glass or a mixture of these materials.

The second insulating material can be a fibrous or microporous product, with a base of different materials such as polycrystalline products (alumina or mullite), silicon dioxide, refractory ceramic, alkaline earth silicate, high-temperature glass, glass or a mixture of these materials.

Preferably, the preferred combinations for the first and second insulating materials are:

- high-temperature glass for the first insulating material and silicon dioxide for the second insulating material, or
- glass for the first insulating material and high-temperature glass for the second insulating material.

According to a variant that is not shown, the first insulating element is formed from a same insulating material as the second insulating elements, but has a thickness smaller than that of the second insulating elements. In this case, the first insulating element can be integral with the second insulating elements.

Figure 2:
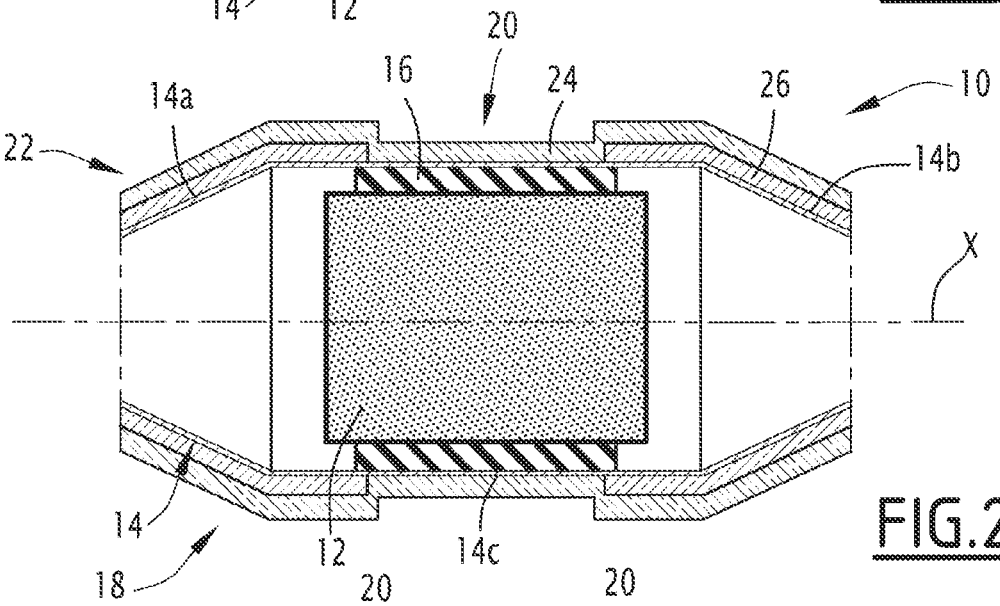
FIG. 2 is a view similar to FIG. 1 of a purification component according to a second exemplary embodiment of the disclosure.

FIG. 2 shows an exhaust gas purification component 10 according to a second exemplary embodiment of the disclosure. In this FIG. 2, the elements similar to those of FIG. 1 are designated using identical references.

In this second embodiment, the purification block 12, the casing 14 and the maintaining elements 16 are identical to those of the first embodiment and will therefore not be described again.

Conversely, the first 20 and second 22 parts of the thermal insulation 18 are made differently, although they are arranged in the same way as in the first embodiment.

More specifically, the purification component 10 includes a first insulating material 24 forming a first layer covering the whole of the casing 14, and a second insulating material 26 forming a second layer covering only the inlet 14*a* and outlet 14*b* portions.

Advantageously, the second insulating material 26 is arranged in contact with the casing 14, and the first insulating material 24 surrounds the second insulating material 26.

Thus, the first part 20 of the thermal insulation 18 is formed only by the first insulating material 24, while the second insulating part 22 of the thermal insulation 18 is formed by superimposing the first insulating material 24 and the second insulating material 26.

In the described example, the second insulating material 26 preferably has a temperature resistance higher than that of the first insulating material 24. Thus, the second insulating material 26 covers the inlet portion 14*a* and the outlet portion 14*b* (in contact with the casing 14), and it is covered by the first insulating material 24.

Figure 3:
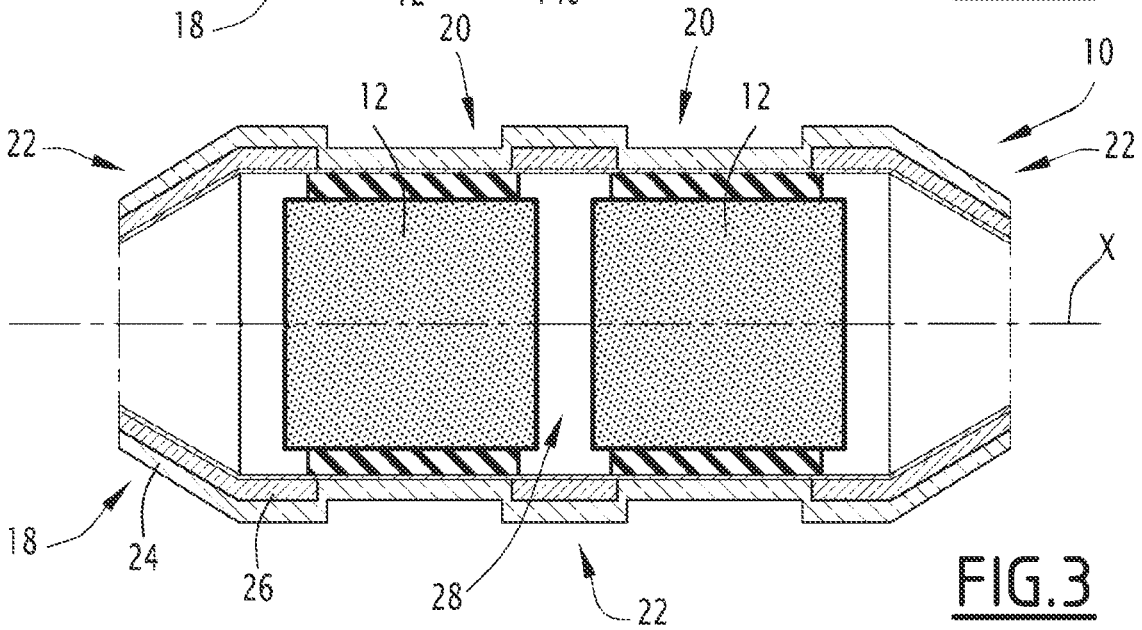
FIG. 3 is a view similar to FIG. 1 of a purification component according to a third exemplary embodiment of the disclosure.

FIG. 3 shows an exhaust gas purification component 10 according to a third exemplary embodiment of the disclosure. In this FIG. 3, the elements similar to those of FIG. 2 are designated using identical references.

According to this third embodiment, the purification component 10 comprises at least two purification blocks 12 in series in the exhaust gas circulation channel, separated in the direction of the longitudinal axis X by a space 28.

In the described example, the first part 20 of the thermal insulation 18 is discontinuous, and extends radially facing each of these purification blocks 12. The second part 22 of the thermal insulation 18 then covers the casing 14 radially facing the space 28 between the purification blocks 12.

In this third embodiment, the first 20 and second 22 parts of the thermal insulation 18 are made, like in the second embodiment, by superpositions of layers of the first 24 and second 26 insulating materials. In a variant, they could, like in the first embodiment, be made from different materials, or in another variant from a same material having different thicknesses of first 20 and second 22 parts of the thermal insulation 18.

It will be noted that the disclosure is not limited to the embodiments previously described, but could take the form of various additional alternatives.

The invention claimed is:

1. An exhaust gas purification component, including:

at least one exhaust gas purification block;

a casing defining a circulation channel for exhaust gases extending along a longitudinal axis, in which the at least one exhaust gas purification block is housed, the casing comprising an inlet portion and an outlet portion, and a central portion arranged between the inlet portion and the outlet portion, the central portion surrounding the at least one exhaust gas purification block; and a thermal insulation covering all of the casing, the thermal insulation comprising:

a first part having a first temperature resistance, arranged radially facing the at least one exhaust gas purification block, a second part, having a second temperature resistance higher than the first temperature resistance, the second part covering at least the inlet portion of the casing, a first layer formed from a first insulating material having the first temperature resistance, and covering an entirety of the casing, and a second layer formed from a second insulating material different from the first insulating material, the second part of the thermal insulation being formed by superimposing the first and second layers.

2. The exhaust gas purification component according to claim 1, wherein the second part of the thermal insulation is discontinuous and covers the outlet portion of the casing.

3. The exhaust gas purification component according to claim 1, wherein the first part of the thermal insulation is formed by a first insulating material, and the second part of the thermal insulation is formed by a second insulating material different from the first insulating material.

4. The exhaust gas purification component according to claim 1, wherein the second insulating material is arranged in contact with the casing, and the first insulating material surrounds the second insulating material.

5. The exhaust gas purification component according claim 1, wherein the first part of the thermal insulation has a first temperature resistance to withstand at least a first temperature, and the second part of the thermal insulation has a second temperature resistance to withstand at least a second temperature, such that:

the second temperature is at least equal to a maximum temperature of the exhaust gases, and the first temperature is at least 100° lower than the second temperature.

6. The exhaust gas purification component according to claim 1, wherein the thermal insulation is radially outward of the casing.

7. The exhaust gas purification component according to claim 6, including at least one retaining element radially outward of the at least one exhaust gas purification block and radially inward of the casing.

8. An exhaust gas purification component, including:

at least one exhaust gas purification block;

a casing defining a circulation channel for exhaust gases extending along a longitudinal axis, in which the at least one exhaust gas purification block is housed, the casing comprising an inlet portion and an outlet portion, and a central portion arranged between the inlet portion and the outlet portion, the central portion surrounding the at least one exhaust gas purification block; and a thermal insulation made of one piece covering all of the casing, the thermal insulation comprising:

a first part having a first temperature resistance, arranged radially facing the at least one exhaust gas purification block, a second part, having a second temperature resistance higher than the first temperature resistance, the second part covering at least the inlet portion of the casing, and wherein the thermal insulation includes a single insulating material, having a first thickness in the first part, and a second thickness greater than the first thickness in the second part.

9. An exhaust gas purification component, including:

at least one exhaust gas purification block;

a casing defining a circulation channel for exhaust gases extending along a longitudinal axis, in which the at least one exhaust gas purification block is housed, the casing comprising an inlet portion and an outlet portion, and a central portion arranged between the inlet portion and the outlet portion, the central portion surrounding the at least one exhaust gas purification block; and a thermal insulation covering all of the casing, the thermal insulation comprising:

a first part having a first temperature resistance, arranged radially facing the at least one exhaust gas purification block, and a second part, having a second temperature resistance higher than the first temperature resistance, the second part covering at least the inlet portion of the casing; and wherein the at least one exhaust gas purification block comprises at least two exhaust gas purification blocks in series in the circulation channel, separated in a direction of the longitudinal axis by a space, the first part of the thermal insulation being discontinuous and extending radially facing each of the at least two exhaust gas purification blocks.

10. The exhaust gas purification component according to claim 9, wherein the second part of the thermal insulation covers the casing radially facing the space between the at least two exhaust gas purification blocks.

11. The exhaust gas purification component according to claim 1, including at least one maintaining element to maintain the at least one exhaust gas purification block, inserted between the casing and the at least one exhaust gas purification block, wherein the first part of the thermal insulation is arranged radially facing the at least one maintaining element.

* * * * *